US008765230B1

(12) United States Patent
Waldrop, III et al.

(10) Patent No.: US 8,765,230 B1
(45) Date of Patent: Jul. 1, 2014

(54) THERMAL BARRIER COATED RF RADOMES AND METHOD

(75) Inventors: John C. Waldrop, III, Saint Charles, MO (US); Daniel E. Driemeyer, Manchester, MO (US); Laura S. Riegel, St. Louis, MO (US); Stanley A. Lawton, Clayton, MO (US)

(73) Assignee: The Boeing Company, Chicago, IL (US)

( * ) Notice: Subject to any disclaimer, the term of this patent is extended or adjusted under 35 U.S.C. 154(b) by 1217 days.

(21) Appl. No.: 12/629,044

(22) Filed: Dec. 1, 2009

(51) Int. Cl.
*B05D 1/38* (2006.01)
*B05D 7/00* (2006.01)
*H01Q 1/42* (2006.01)

(52) U.S. Cl.
USPC ..... 427/402; 343/872

(58) Field of Classification Search
USPC ..... 427/402; 343/872
See application file for complete search history.

(56) References Cited

U.S. PATENT DOCUMENTS 3,314,070 A * 4/1967 Youngren ..... 343/708
3,839,078 A * 10/1974 Birchall et al. ..... 427/377
4,364,884 A * 12/1982 Traut ..... 264/118
5,408,244 A * 4/1995 Mackenzie ..... 343/872
5,616,650 A * 4/1997 Becker et al. ..... 525/102
8,178,205 B2 * 5/2012 Hong ..... 428/423.1
2004/0011245 A1 * 1/2004 Sambasivan et al. ..... 106/14.12
2012/0094036 A1 * 4/2012 Droege et al. ..... 427/600

OTHER PUBLICATIONS

Daniel C. Harris, "Materials for Infrared Windows and Domes Properties and Performance", SPIE Optical Engineering Press, Bellingham, WA, Textbook Table of Contents.

* cited by examiner

*Primary Examiner* — Michael Wieczorek
*Assistant Examiner* — James M Mellott

(57) ABSTRACT

Thermal barrier coated RF radomes and a method for making the same are provided. In an embodiment of the disclosure, there is provided a method for making a thermal barrier coated radio frequency (RF) radome. The method comprises providing a radio frequency (RF) radome. The method further comprises applying a thermal barrier coating having a dielectric constant less than about 2.0 onto a surface of the radome to form a thermal barrier coated RF radome. The thermal barrier coating reduces a structure temperature of the radome by greater than 300 degrees Fahrenheit to enhance thermomechanical properties and performance of the RF radome.

23 Claims, 8 Drawing Sheets

THERMAL BARRIER COATED RF RADOMES AND METHOD

BACKGROUND

1) Field of the Disclosure

The disclosure relates to radomes, and in particular, to radio frequency (RF) radomes used at high temperatures.

2) Description of Related Art

RF (radio frequency) radomes are structures that may be used on high speed aircraft, missiles, supersonic airframes, spacecraft, and other craft. RF radomes are typically used to cover instruments, such as radar devices and antennas, that transmit and receive electromagnetic and RF radiation, in order to protect such devices from environmental conditions and mechanical stresses. RF radomes are constructed to be substantially transparent to RF radiation over broadband or narrowband frequencies. The surfaces of high speed aircraft, missiles, supersonic airframes, spacecraft, and other craft are often subjected to aerodynamic heating, extreme environmental conditions, and significant mechanical stresses and erosion, which can all affect their performance. Such high speed aircraft, missiles, supersonic airframes, and spacecraft require RF radomes with good thermo-mechanical properties that can survive extended high temperature exposures (e.g., above 700 degrees Fahrenheit), severe thermal gradients, and most weather or atmospheric conditions with low-loss, uniform, and stable signal transmission, at a reasonable cost.

Material selection for an RF radome may affect the RF radome thermo-mechanical properties, operating temperature, strength, impact and weather resistance, dielectric loss, signal transmission, and manufacturing tolerances. For example, known RF radomes may be made of polymeric matrix composites (PMCs), ceramic matrix composites (CMCs) and monolithic ceramic materials. As flight speed increases, the typical solution set progresses from PMCs to CMCs and finally to monolithic ceramics. Examples of PMCs include glass/epoxy, quartz/bismaleimide, quartz/cyanate ester, quartz/polyimide, and alumina-boria-silica fibers/polybenzimidazole. Examples of CMCs include quartz/polysiloxane, quartz/polysilazane, and oxide/oxides such as alumina-boria-silica fibers/aluminum silicate. Examples of monolithic ceramic materials include fully dense silicon nitride ($Si_3N_4$), in situ reinforced barium aluminum silicate (IRBAS), reaction bonded silicon nitride (RBSN), polycrystalline glass ceramic, fused silica, and gel cast silicon aluminum oxynitride (SiAlON).

In a typical high speed flight profile, severe atmospheric induced drag can result in elevated surface temperatures on an RF radome structure, such as shown in FIG. 9. The aerodynamic heating is typically most severe at a forward tip of the RF radome and may be gradually reduced with increasing distance from the tip. Since RF radomes are typically made of a single material, the aerodynamic heating in a forward sector of an RF radome often drives the material selection to higher temperature capable materials. Such materials, however, are generally more expensive and may be subject to various limitations. For example, radomes made of PMCs have excellent transmission properties, low weight, low manufacturing costs, good uniformity, and excellent fracture resistance. However, such radomes may have reduced thermal properties and reduced erosion resistance in high speed flight. In addition, excessive temperature can cause PMCs to decompose during flight. Such decomposition may lead to surface roughness which can increase drag and aerodynamic heating and increase deterioration in signal transmission.

Radomes made of CMCs are similar to radomes made of PMCs except that radomes made of CMCs have slightly higher temperature capabilities and consequently can be more stable at high temperatures. Some CMCs can be produced with excellent dimensional control and require no surface treatment such as milling, so that such CMCs are more affordable and less expensive than monolithic ceramics. However, radomes made of CMC can be more expensive than radomes made of PMCs. Radomes made of CMCs may have reduced erosion resistance which may result in excessive material or ply loss. CMC radomes can have significant porosity which may result in fluid intrusion into the radome, may outgas during flight, and may have reduced RF transmission properties.

Radomes made of monolithic ceramics typically have higher temperature capabilities and better erosion resistance than radomes made of PMCs or CMCs. However, radomes made of monolithic ceramics can be significantly more expensive to produce than radomes made of PMCs or CMCs. Such radomes made of monolithic ceramics may require machining on green ceramics and/or grinding of fully hardened ceramics to achieve precision dimensional control which can result in increased production costs and lower yields. Moreover, radomes made of monolithic ceramics may have less robust performance from impact shock loads or high internal stresses from large internal temperature gradients. Radomes made of monolithic ceramics typically have higher dielectric and loss properties that reduce the effectiveness of signal transmission compared to radomes made of PMCs or CMCs.

Thus, existing materials may be expensive and may be subject to reduced performance and surviveability under extended high temperature exposures (e.g., above 400 degrees Fahrenheit), severe thermal gradients, and extreme weather or atmospheric conditions. It is believed that known RF radomes do not use thermal barrier coatings to enhance or extend radome performance capabilities.

Accordingly, there is a need for RF radomes and method having enhanced performance in high temperature applications, enhanced all weather flight capability, enhanced thermal environment surviveability, and that provide advantages over known devices and methods.

SUMMARY

This need for RF radomes and method is satisfied. Unlike known devices and methods, embodiments of the RF radomes and method may provide one or more of the following advantages: provides RF radomes with thermal barrier coatings that enhance performance of the RF radomes in high temperature applications, enhance all weather flight capability of the RF radomes, and enhance thermal environment surviveability of the RF radomes; provides thermal barrier coated RF radomes that do not significantly degrade signal transmission in RF radomes, that extend a flight performance envelope for a given radome material, that expand flight envelopes for increased, longer duration aero-heating, and that reduce radome exposure temperatures; provides thermal barrier coated RF radomes that allow for lower cost material substitutions, that reduce thermal stresses by lowering thermal gradients along the length and through the thickness of the radome, and that provide subsonic erosion protection in captive carry; provides thermal barrier coated RF radomes that provide protection from handling loads and low velocity impacts, that provide sacrificial erosion protection in supersonic and hypersonic flights, that reduce radome life cycle costs, and that improve survival and absorb impact energy from encounters with rain, snow, fog, atmospheric particles, dust particles, and other environmental elements and conditions to prevent failures of the radomes; provides thermal barrier coated RF radomes that reduce thermal load on internal electronics for improved electrical and guidance reliability, improve overall survivability of radomes and flight vehicles, permit extended duration flights, and apply to multiple candidate radome materials; provides thermal barrier coated RF radomes having enhanced performance in high temperature applications, such as temperatures over 400 degrees Fahrenheit; provides thermal barrier coated RF radomes that may result in a flight vehicle with increased speed capability, lower cost, robust and improved mission reliability such as targeting reliability, and improved system effectiveness.

In an embodiment of the disclosure, there is provided a method for coating a radio frequency (RF) radome. The method comprises providing a radio frequency (RF) radome. The method further comprises applying a thermal barrier coating having a dielectric constant less than about 2.0 onto a surface of the radome to form a thermal barrier coated RF radome. The thermal barrier coating reduces a structure temperature of the RF radome by greater than 300 degrees Fahrenheit to enhance thermo-mechanical properties and performance of the RF radome.

In another embodiment of the disclosure, there is provided a method for coating a high speed radio frequency (RF) radome. The method comprises providing a high speed radio frequency (RF) radome. The method further comprises treating a surface to be coated on the radome with a surface treatment process selected from the group comprising chemical etching, grit blasting, sanding, liquid honing, corona treatment, peel ply treatment, or a combination thereof. The method further comprises applying a thermal barrier coating onto a surface of the radome at an effective temperature of less than 350 degrees Fahrenheit to form a thermal barrier coated RF radome. The thermal barrier coating has a dielectric constant less than about 2.0, has a porosity of up to 80% by volume of the thermal barrier coating, and has a tapered thickness in a range of from about 0.002 inch to about 0.20 inch, such that a first thickness of the thermal barrier coating on a forward sector of the radome is greater than a second thickness of the thermal barrier coating on an aft sector of the radome. The thermal barrier coating reduces a structure temperature of the RF radome by greater than 300 degrees Fahrenheit to enhance thermo-mechanical properties, performance, all weather flight capability, and environment surviveability of the RF radome. The method further comprises drying the thermal barrier coated RF radome at a temperature of less than 350 degrees Fahrenheit for an effective period of time. The method further comprises finishing the thermal barrier coated RF radome with a finishing process selected from the group comprising milling, sanding, cleaning with filtered compressed air, solvent cleaning, or a combination thereof. The method further comprises applying a waterproof material to the thermal coated RF radome, wherein the waterproof material is selected from the group comprising a waterproofing sealant, hexamethyldisilazane (HMDS), dimethyldiethoxysilane (DMDES), other suitable silane based chemistries, a waterproofing sealant, or another suitable waterproof material. The method further comprises applying a sealant to the thermal barrier coated RF radome, wherein the sealant is preferably resistant to a temperature of greater than 700 degrees Fahrenheit and is selected from the group comprising silicon ceramic matrix materials, silica, silicon carbide, aluminum silicate, aluminum phosphate, toughened low temperature cure (TLTC) silicone, TLTC fluoroelastomers, TLTC polyurethane sealants, and aromatic hydrocarbon resin.

In another embodiment of the disclosure, there is provided a thermal barrier coated radio frequency (RF) radome. The radome comprises a radio frequency (RF) radome comprising an exterior surface, an interior surface, a tip, and a base, wherein the RF radome is designed to transmit RF signals. The radome further comprises a thermal barrier coating applied to an exterior surface of the radome. The thermal barrier coating has a dielectric constant of less than about 2.0. The thermal barrier coating reduces a structure temperature of the RF radome by greater than 300 degrees Fahrenheit to enhance thermo-mechanical properties and performance of the RF radome.

The features, functions, and advantages that have been discussed can be achieved independently in various embodiments of the disclosure or may be combined in yet other embodiments further details of which can be seen with reference to the following description and drawings.

BRIEF DESCRIPTION OF THE DRAWINGS

The disclosure can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art.

Figure 1:
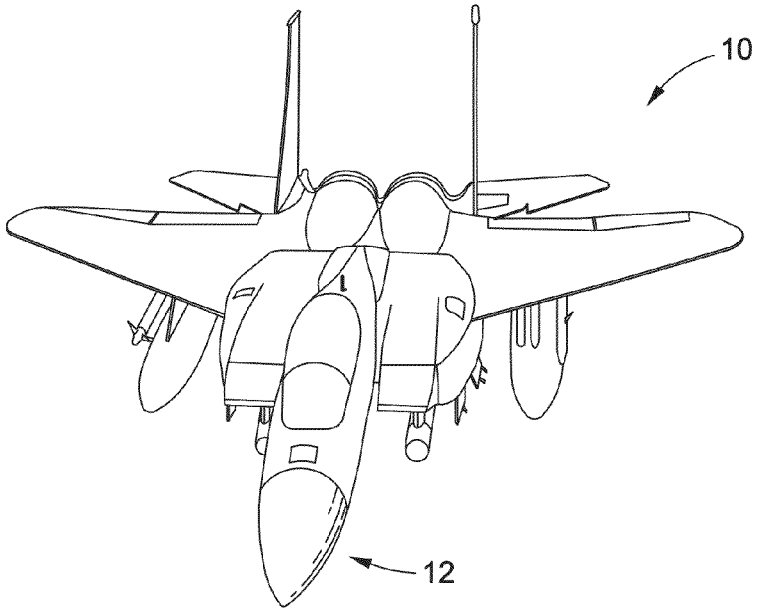
FIG. 1 is an illustration of a front perspective view of an aircraft having an exemplary RF radome.
Figure 2:
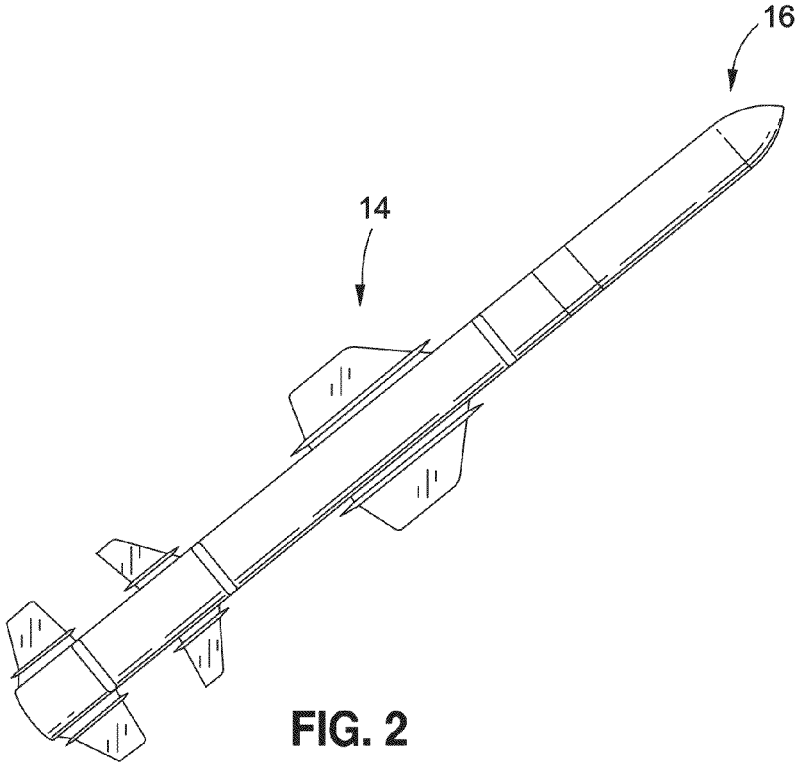
FIG. 2 is an illustration of a side view of a missile having an exemplary RF radome.

FIG. 1 is an illustration of a front perspective view of an aircraft 10 having an exemplary RF radome 12 that may be coated using the thermal barrier coatings disclosed herein. FIG. 2 is an illustration of a side view of a missile 14 having an exemplary RF radome 16 that may be coated using the thermal barrier coatings disclosed herein. Preferably, the thermal barrier coatings disclosed herein may be used to coat high speed RF radomes used in high speed aircraft, missiles, supersonic airframes, spacecraft, and other craft that may be subjected to severe aerodynamic heating, extreme environmental conditions, and significant mechanical stresses and erosion. More preferably, the thermal barrier coatings disclosed herein may be used to coat high speed RF radomes for supersonic airframes having a Mach number greater than Mach 2. For purposes of this application, the term "Mach number" means the speed of an object, such as an aircraft or missile, moving through air or any fluid substance divided by the speed of sound in air or that substance.

Figure 3:
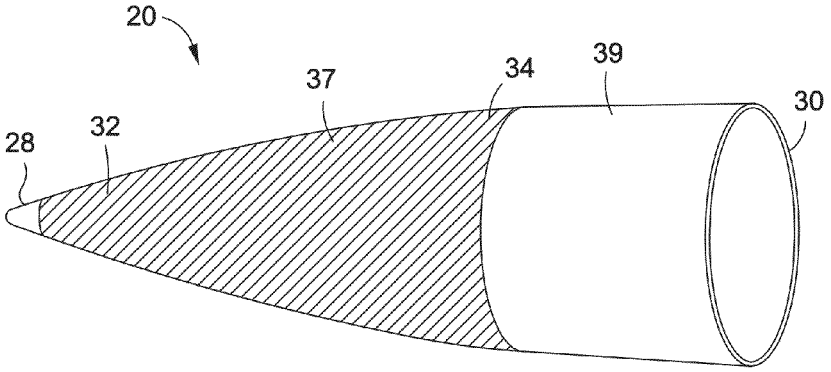
FIG. 3 is an illustration of a perspective view of an embodiment of a thermal barrier coated RF radome of the disclosure with an assembled tip.
Figure 4A:
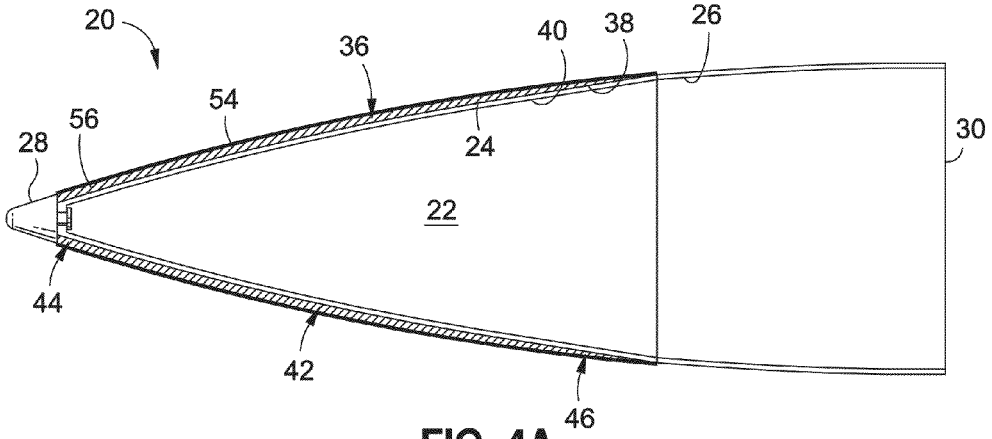
FIG. 4A is an illustration of the RF radome of FIG. 3 in partial cross section and having a thermal barrier coating with a tapered thickness.
Figure 4B:
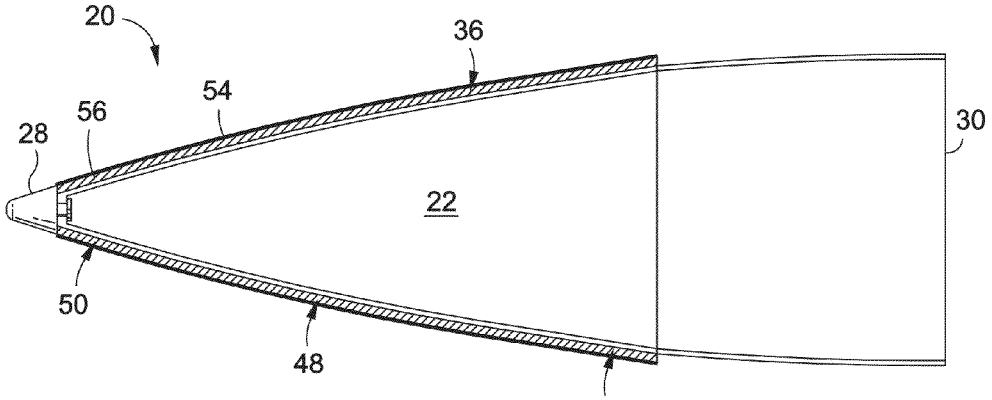
FIG. 4B is an illustration of the RF radome of FIG. 3 in partial cross section and having a thermal barrier coating with a uniform thickness.

FIG. 3 is an illustration of a perspective view of an embodiment of a thermal barrier coated RF radome 20 of the disclosure having an assembled tip 28. FIG. 4A is an illustration of the RF radome of FIG. 3 in partial cross section and having a thermal barrier coating 36 with a tapered thickness 42. FIG. 4B is an illustration of the RF radome of FIG. 3 in partial cross section and having a thermal barrier coating with a uniform thickness 48. As shown in FIGS. 3-4, the thermal barrier coated RF radome 20 comprises an RF radome 22 having an exterior surface 24, an interior surface 26, an assembled tip 28, and a base 30. The RF radome 22 has a forward sector or portion 32 and an aft sector or portion 34. The RF radome 22 is preferably designed to transmit RF signals. The RF radome 22 may be made of a material such as polymeric matrix composites (PMCs) including glass/epoxy, quartz/bismaleimide, quartz/cyanate ester, quartz/polyimide, and alumina-boria-silica fibers (such as 3M NEXTEL 312 from 3M Company of St. Paul, Minn. —NEXTEL is a registered trademark of 3M Company of St. Paul, Minn.)/polybenzimidazole; ceramic matrix composites (CMCs) including quartz/polysiloxane, quartz/polysilazane, oxide/oxides, and alumina-boria-silica fibers (such as 3M NEXTEL 312)/aluminum silicate; or monolithic ceramics including fully dense silicon nitride ($Si_3N_4$), reaction bonded silicon nitride, in situ reinforced barium aluminum silicate (IRBAS), PYROCERAM 9606 polycrystalline glass ceramic (from Corning Incorporated of Corning, N.Y. —PYROCERAM is a registered trademark of Corning Incorporated of Corning N.Y.), fused silica, and gel cast silicon aluminum oxy nitride (SiAlON). However, the RF radome may also be made of other suitable materials.

The thermal barrier coated RF radome 20 further comprises a thermal barrier coating 36 preferably applied to one or more portions 38 of the exterior surface 24 of the RF radome 22. The thermal barrier coating 36 may also be applied to one or more portions 40 of the interior surface 26 of the RF radome 22. As shown in FIG. 3, there is a coated portion 37 and an uncoated portion 39. In this embodiment, the thermal barrier coating 36 is not applied to the assembled tip 28. In one embodiment, as shown in FIG. 4A, the thermal barrier coating 36 preferably has a tapered thickness 42, such that a first thickness 44 of the thermal barrier coating 36 on the forward sector 32 of the RF radome 22 is greater than a second thickness 46 of the thermal barrier coating 36 on the aft sector 34 of the RF radome 22. Preferably, the tapered thickness 42 of the thermal barrier coating 36 may be in a range of from about 0.002 inch to about 0.20 inch. Alternatively, the thermal barrier coating 36 may have a substantially uniform thickness 48, such that a first thickness 50 of the thermal barrier coating 36 on the forward sector 32 of the RF radome 22 is substantially equal to a second thickness 52 of the thermal barrier coating 36 on the aft sector 34 of the RF radome. Preferably, the uniform thickness 48 of the thermal barrier coating 36 is in a range of from about 0.050 inch to about 0.20 inch. In a preferred embodiment, a thermal barrier coating having a tapered thickness may be applied with a greater first thickness at the tip of the radome (see FIG. 6A, discussed below). Such preferred thermal barrier coating deposition has a tapered buildup extended from the tip area to approximately one-half the length of the RF radome. However, suitable variations may be possible, including coating the entire radome, for performance optimization. By applying the thermal barrier coatings primarily to the forward sector of radomes, lower structural radome component temperatures and reduced temperature gradients along the length and through the thickness of the RF radome structure can be achieved.

The thermal barrier coating preferably has a dielectric constant of less than about 2.0. More preferably, the thermal barrier coating has a dielectric constant of less than about 1.5. The thermal barrier coating preferably reduces an RF radome structure temperature by greater than 300 degrees Fahrenheit and enhances thermo-mechanical properties, performance, all weather flight capability, and environment surviveability of the RF radome, and in particular, at high temperatures, e.g., above 700 degrees Fahrenheit. The thermal barrier coating preferably has a high porosity of up to 80% by volume of the thermal barrier coating. The thermal barrier coating is preferably a material having a low dielectric constant, a low loss tangent, a low density, a low thermal conductivity, a high temperature resistance, a significant hardness for erosion resistance at elevated temperatures, an energy absorption mechanism for particle impact, and excellent adhesion to the radome structural component. The thermal barrier coating may provide handling protection, all weather erosion protection, and radome shatter protection from high energy collisions. To create preferred thermal barrier coatings having very low dielectric properties (less than 2.0 dielectric constant), it is preferable to use constituent materials with inherently low dielectric properties, to introduce porosity into the coating application, and to use aerogels and micro-balloon based materials with low bulk density. The thermal barrier coatings are formulated with low dielectric properties to maintain excellent radio frequency signal transmission with minimal pattern distortions.

Preferred thermal barrier coatings may include ablating (charring) or non-ablating (non-charring) formulations. However, the thermal barrier coatings may also comprise other suitable materials. Preferred ablating or charring materials may comprise nano polytetrafluoroethylene (PTFE) with or without glass or quartz micro-balloons; micro porous polytetrafluoroethylene (PTFE) with or without glass or quartz micro-balloons; silicone; entrained air; glass micro-balloons; milled glass fiber; phenolic foam phenolic micro-balloons; syntactic polysiloxane foams, or another suitable charring material formulation.

Non-ablating or non-charring formulations may be more aerodynamically shape stable and can include higher temperature capable materials based on ceramic constituents. Preferred non-ablating or non-charring materials may comprise silica aerogel; alumina aerogel; silica micro-balloons; alumina micro-balloons; quartz milled fibers; alumina-boria-silica milled fibers, silicate based binders with entrained porosity; aluminum phosphate; sodium silicate; potassium silicate; barium aluminum silicate; aluminum silicate, or another suitable non-charring material. Most preferred non-charring formulations use silica and/or alumina aerogels, silica and/or alumina micro-balloons, quartz milled fibers, and a silicate based binder with entrained porosity. Aluminum phosphate with its low dielectric properties may also be effective as a binder material. Water-based binders, such as sodium silicate; potassium silicate; barium silicate; aluminum silicate, may be dried at low temperatures (less than 200 degrees Fahrenheit) and then cure to a durable ceramic insulating layer during flight or through a higher temperature bake operation.

Preferred thermal barrier coating formulations may incorporate milled dielectric fiber reinforcements of glass, quartz, alumina-boria-silica fibers (such as 3M NEXTEL 312 from 3M Company of St. Paul, Minn. —NEXTEL is a registered trademark of 3M Company of St. Paul, Minn.), or silicon nitride for strength enhancements, particularly in high porosity versions. The use of micro-balloons can increase the coating hardness while keeping thermal conductivity low and increasing particle impact energy absorption through crush mechanisms. The aerogels, micro-balloons, milled fibers, and porosity work as a system to minimize thermal conductivity and dielectric properties while enhancing energy absorption capability. Weight gain from the applied coating can be low due to the use of micro-balloon and aerogel materials in a porous coating construction. Porosity can be entrained to create closed cell and/or open cell foam architecture. Impact energy from particle encounters may be absorbed, dispersed, and dissipated through sacrificial crushing and dispersion that occurs in the thermal barrier coating at the impact site. Many possible coating formulations and deviations can be envisioned to achieve ideal thermal barrier coating properties for a given radome application. Trades can be made in the coating formulation to adjust thermal conductivity, hardness, energy absorption, density, and erosion resistance.

The thermal barrier coated RF radome 20 may further comprise a high temperature sealant 54 that is preferably resistant to a temperature of greater than 700 degrees Fahrenheit and that may be applied to an exterior surface 56 of the thermal barrier coated RF radome. A coating of the high temperature sealant may be applied over the thermal barrier coating for improving aerodynamic smoothing, hindering fluid absorption, improved durability, and erosion resistance. The sealant 54 may comprise silicon ceramic matrix materials The method further comprises applying a sealant to the thermal barrier coated RF radome, wherein the sealant is resistant to a temperature of greater than 700 degrees Fahrenheit and is selected from the group comprising silicon ceramic matrix materials such as Dampney THURMALOX 240 or 243 silica coatings (from Dampney Company, Inc. of Everett, Mass. —THURMALOX is a registered trademark of Dampney Company, Inc. of Everett, Mass.); silicon carbide; Kerathin 1700 aluminum silicate (from Rath USA of Newark, Del.); Mid-Mountain Materials THERMOSEAL P110 aluminum silicate thermal coating (from Mid-Mountain Materials, Inc. of Mercer Island, Wash. —THERMOSEAL is a registered trademark of Mid-Mountain Materials, Inc. of Mercer Island, Wash.); aluminum phosphate; toughened low temperature cure (TLTC) sealants such as silicone, fluoroelastomer, or polyurethane sealants; aluminum phosphate; aromatic hydrocarbon resin sealant; or another suitable sealant. Prior to application of the sealant to the thermal barrier coated RF radome, the thermal barrier coated RF radome may be treated with a coating of a waterproof material (not shown) to increase the hydrophobicity of the thermal barrier coated RF radome. The waterproof material may comprise hexamethyldisilazane (HMDS), dimethyldiethoxysilane (DMDES), and other silane based chemistries, a waterproofing sealant, or another suitable waterproof material.

Figure 5:
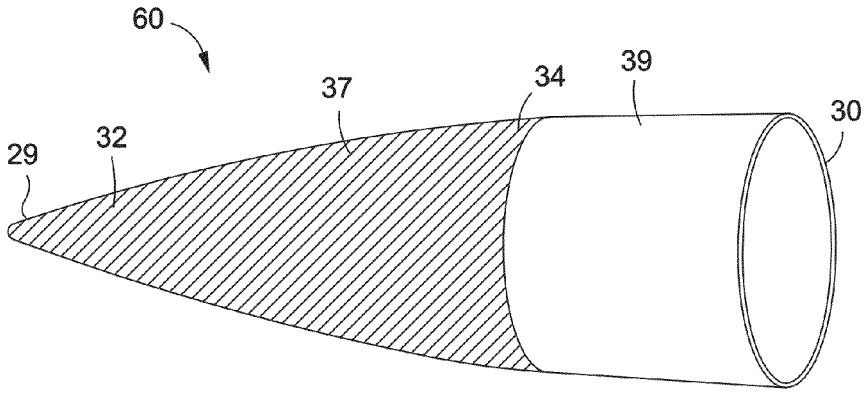
FIG. 5 is an illustration of a perspective view of another embodiment of a thermal barrier coated RF radome of the disclosure with an integrated tip.
Figure 6A:
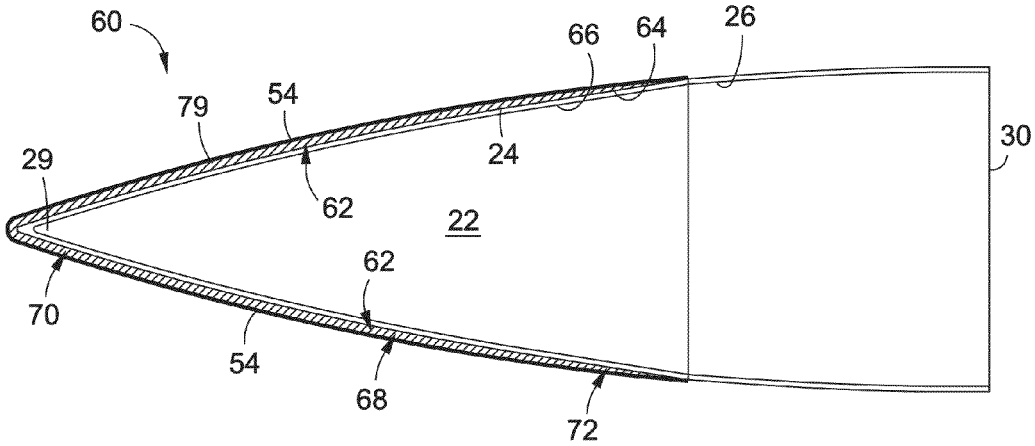
FIG. 6A is an illustration of the RF radome of FIG. 5 in partial cross section and having a thermal barrier coating with a tapered thickness.
Figure 6B:
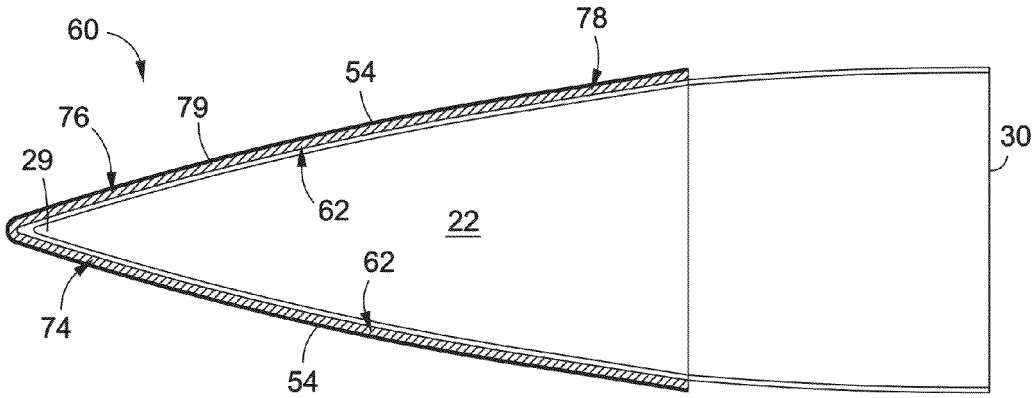
FIG. 6B is an illustration of the RF radome of FIG. 5 in partial cross section and having a thermal barrier coating with a uniform thickness.

FIG. 5 is an illustration of a perspective view of another embodiment of a thermal barrier coated RF radome 60 of the disclosure with an integral tip 29. FIG. 6A is an illustration of the RF radome of FIG. 5 in partial cross section and having a thermal barrier coating with a tapered thickness. FIG. 6B is an illustration of the RF radome of FIG. 5 in partial cross section and having a thermal barrier coating with a uniform thickness. As shown in FIGS. 5-6, the thermal barrier coated RF radome 60 comprises the RF radome 22 discussed above in relation to FIGS. 3-4, having exterior surface 24, interior surface 26, integral tip 29, and base 30. The RF radome 22 has forward sector or portion 32 and aft sector or portion 34. The RF radome 22 is preferably designed to transmit RF signals. The RF radome 22 may be made of a material as discussed above. The thermal barrier coated RF radome 60 further comprises a thermal barrier coating 62 preferably applied to one or more portions 64 of the exterior surface 24 of the RF radome 22. The thermal barrier coating 62 may also be applied to one or more portions 66 of the interior surface 26 of the RF radome 22. As shown in FIG. 5, there is a coated portion 37 and an uncoated portion 39. In this embodiment, the thermal barrier coating 62 is applied to the integral tip 29.

In one embodiment, as shown in FIG. 6A, the thermal barrier coating 62 preferably has a tapered thickness 68, such that a first thickness 70 of the thermal barrier coating 62 on the forward sector 32 of the RF radome 22 is greater than a second thickness 72 of the thermal barrier coating 62 on the aft sector 34 of the RF radome 22. Preferably, the tapered thickness 68 of the thermal barrier coating 62 may be in a range of from about 0.002 inch to about 0.20 inch. Alternatively, the thermal barrier coating 62 may have a substantially uniform thickness 74, such that a first thickness 76 of the thermal barrier coating 62 on the forward sector 32 of the RF radome 22 is substantially equal to a second thickness 78 of the thermal barrier coating 62 on the aft sector 34 of the RF radome 22. Preferably, the uniform thickness 74 of the thermal barrier coating 62 is in a range of from about 0.050 inch to about 0.20 inch. In a preferred embodiment, the thermal barrier coating 62 having the tapered thickness 68 may be applied with a greater first thickness 70 at the integral tip 29 of the RF radome 22. Such preferred thermal barrier coating deposition has a tapered buildup extended from the tip area to approximately one-half the length of the RF radome. However, suitable variations may be possible, including coating the entire radome, for performance optimization. The thermal barrier coated RF radome 60 may further comprise a high temperature sealant 54, as discussed above, that is resistant to a temperature of greater than 700 degrees Fahrenheit and that may be applied to an exterior surface 79 of the thermal barrier coated RF radome 60.

Figure 7:
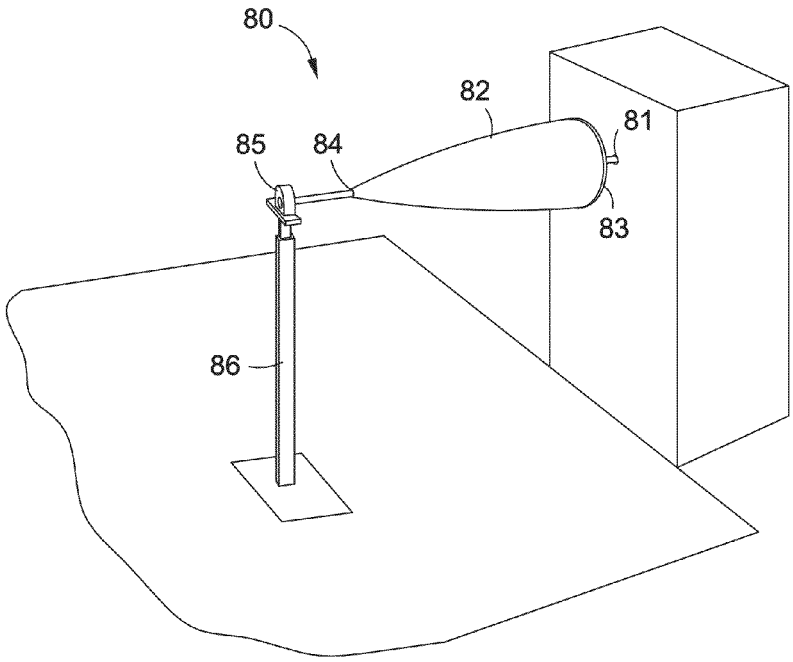
FIG. 7 is an illustration of a perspective view of a rotating device for robotic spray application of an embodiment of a thermal barrier coating of the disclosure to an RF radome.

The thermal barrier coatings disclosed herein may be applied to RF radomes in various ways. As shown in FIG. 7, an exemplary set-up apparatus 80 for robotic spray application of thermal barrier coatings to RF radomes is shown. FIG. 7 is an illustration of a perspective view of an electric rotating drive device 81 of the set-up apparatus 80 for robotic spray application of an embodiment of a thermal barrier coating of the disclosure to an RF radome 82. FIG. 7 shows the RF radome 82 to be coated having a tangent ogive shape. A closeout base 83 of the RF radome 82 may be attached to the electric rotating drive device 81. A tip 84 of the RF radome 82 may be attached to a journal bearing 85 on a stand 86. A robotic spray applicator (not shown) may be used to coat the RF radome 82 with one of the thermal barrier coatings disclosed herein.

Figure 8:
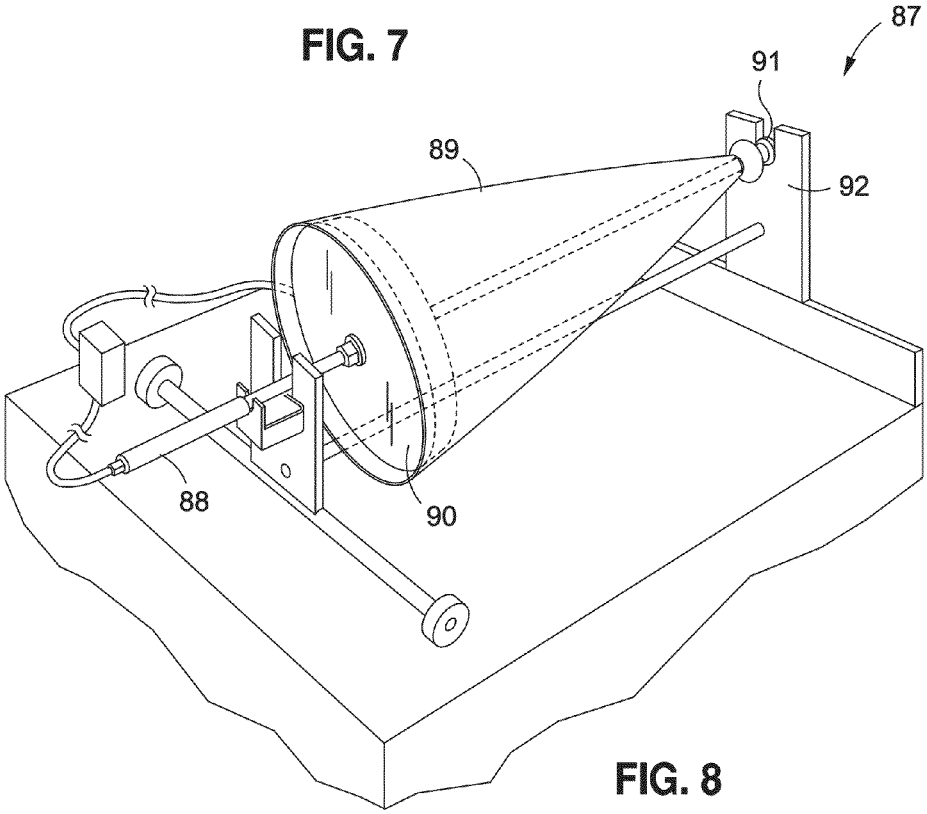
FIG. 8 is an illustration of a perspective view of a pneumatic rotating drive for robotic spray application of an embodiment of a thermal barrier coating of the disclosure to an RF radome.

As shown in FIG. 8, another exemplary set-up apparatus 87 for robotic spray application of thermal barrier coatings to RF radomes is shown. FIG. 8 is an illustration of a perspective view of a pneumatic rotating drive device 88 of the set-up apparatus 87 for robotic spray application of an embodiment of a thermal barrier coating of the disclosure to an RF radome 89. FIG. 8 shows the RF radome 89 to be coated having a cone shape. A closeout base 90 of the RF radome 89 may be attached to the pneumatic rotating drive device 88. A tip 91 of the RF radome 89 may be coupled to a slotted holder 92. A robotic spray applicator (not shown) may be used to coat the RF radome 89 with one of the thermal barrier coatings disclosed herein. In another embodiment (not shown), the RF radome may be mounted vertically on a rotating turntable for coating with a robotic spray applicator.

The thermal barrier coatings may be applied to the RF radome surface through application processes such as robotic spray coating discussed above, thermal spray coating, direct molding onto the radome from syntactic paste or dough-like formulations, secondary bonding of a pre-molded thermal barrier coating, such as a boot or cap, with a high temperature adhesive such as a ceramic adhesive, or another suitable process. It is expected that adequate dimensional control may be achieved with both the robotic spray and direct molding processes such that secondary machining is not required to achieve desired thicknesses and contours.

Figure 9:
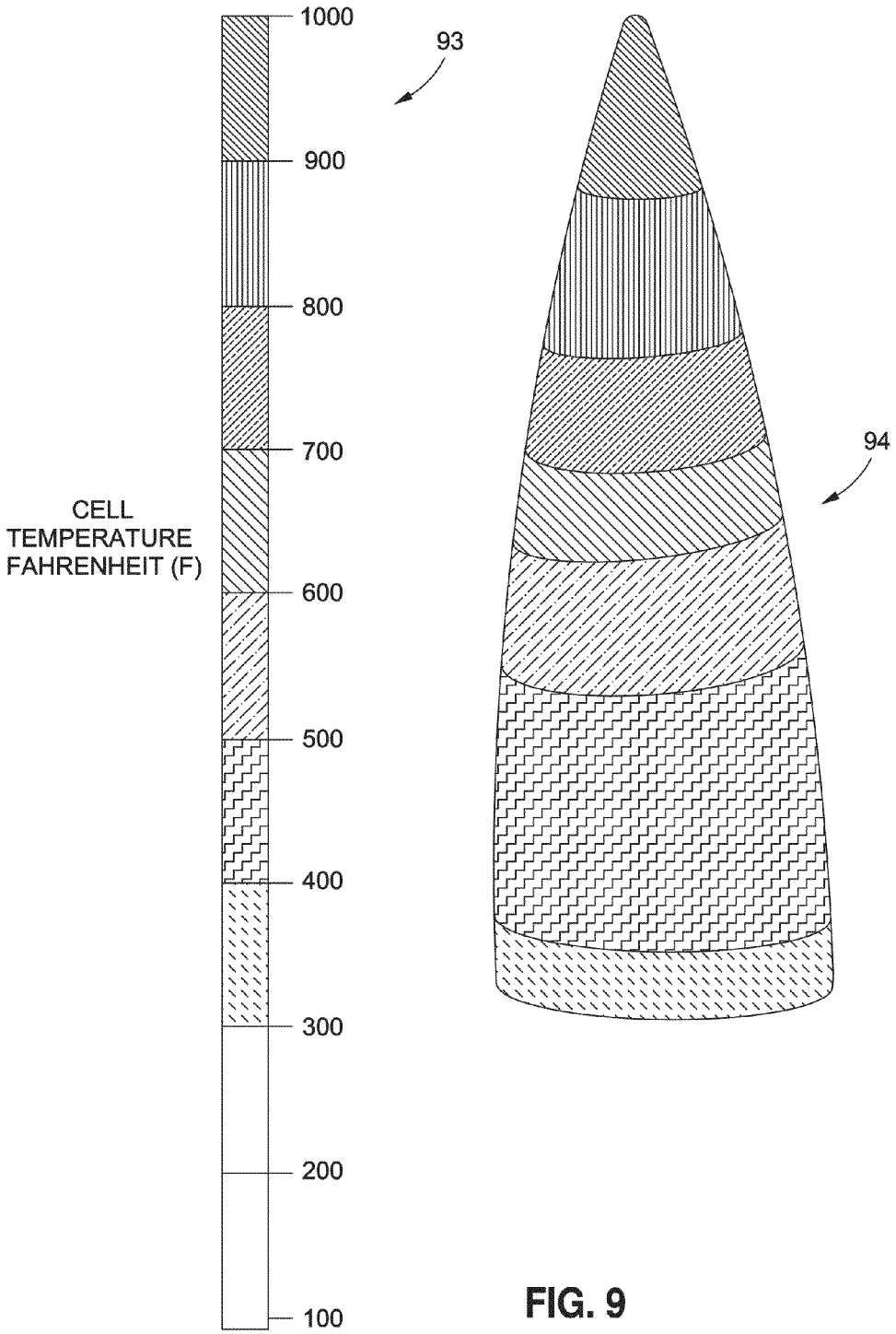
FIG. 9 is an illustration of typical temperature gradients in an uncoated high speed RF radome.

FIG. 9 is an illustration of typical temperature gradients 93 in an uncoated high speed RF radome 94. In a typical high speed flight profile, severe atmospheric induced drag results in elevated surface temperatures on a radome surface structure as shown in FIG. 9. The aerodynamic heating is typically most severe at the tip of the radome and is gradually reduced with increasing distance from the tip.

Thermal Analyses Results—

Figure 10:
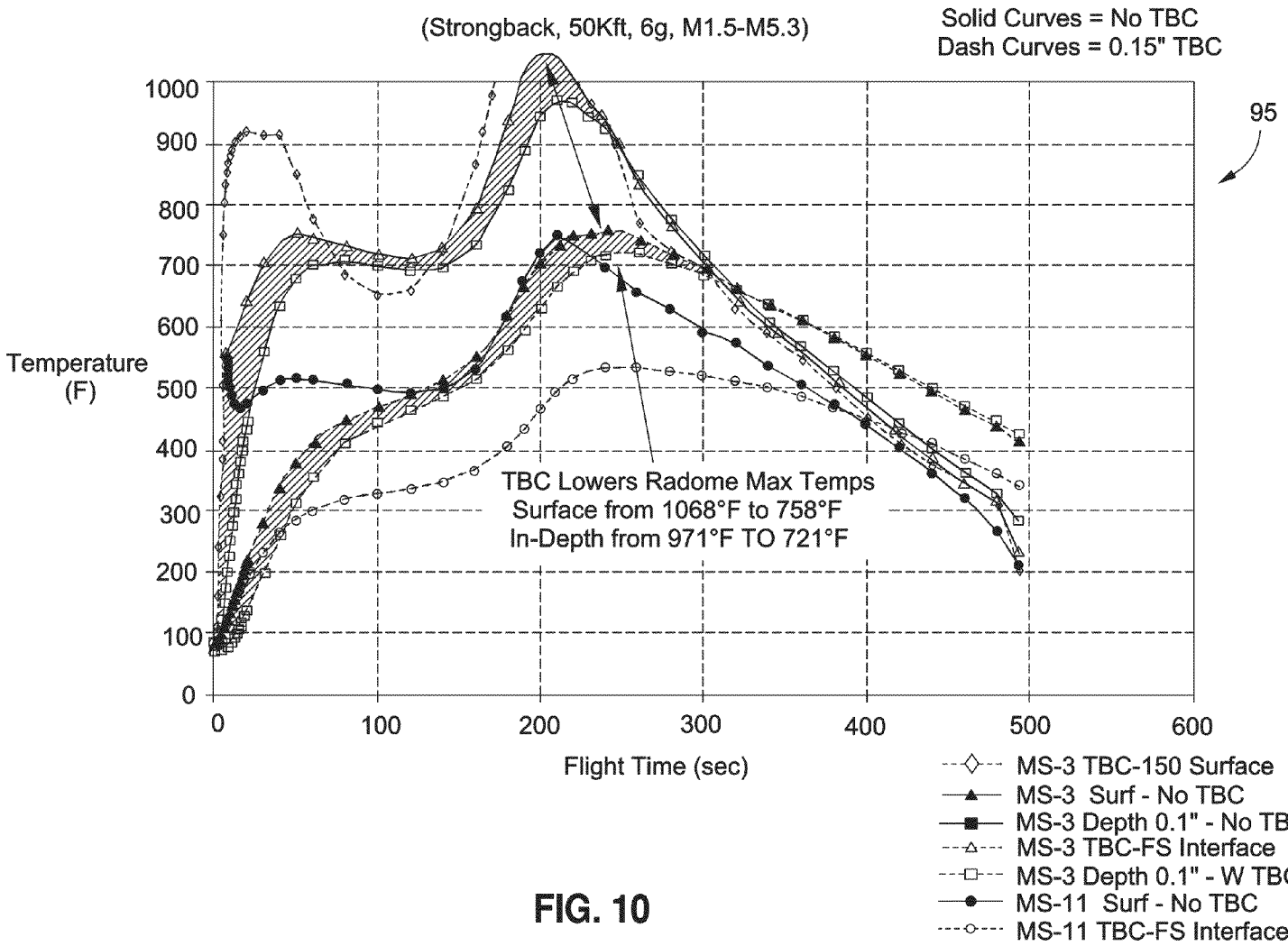
FIG. 10 is an illustration of a graph showing results of a thermal analysis performed with and without embodiments of the thermal barrier coating disclosed herein.

FIG. 10 is an illustration of a graph 95 showing results of a thermal analysis performed on a RF radome coated with embodiments of the thermal barrier coating disclosed herein. Thermal modeling analyses were conducted using a typical flight trajectory. Thermal analyses were performed using the Aeroheating and Thermal Analysis Code (ATAC) on RF radomes with and without a thermal barrier coating. The analyses were performed with two radome base materials (quartz/polysiloxane and silicon nitride), two radome thicknesses (0.20 in. (inch) and 0.15 in.), and two thermal barrier coating thicknesses (0.10 in. and 0.15 in.) with the combined structure and barrier coating thickness held constant at 0.3 inch. FIG. 10 only shows results for a quartz/polysiloxane radome structure. In graph 95 the solid curves indicate temperatures with no thermal barrier coatings and the dash curves indicate temperatures with 0.15 inch thermal barrier coating. "MS-3 TBC—150 Surface" means Missile Station, 3 inches from the tip of the radome, coated with a thermal barrier coating of 0.15 inch thick (150 thousandths of an inch thick). "MS-3 Surf—No TBC" means Missile Station, 3 inches from the tip of the radome, on the surface of the radome structure that has no thermal barrier coating. "MS-3 Depth 0.1"—No TBC" means Missile Station, 3 inches from the tip of the radome, at a depth of 0.1 inch into the radome structure that has no thermal barrier coating. "MS-3 TBC FS Interface" means Missile Station, 3 inches from the tip of the radome, at the interface between the 0.15 inch thick thermal barrier coating and the radome structure. These temperatures correlate to the "MS-3 Surf—No TBC curve". "MS-3 Depth 0.1"—W TBC" means Missile Station, 3 inches from the tip of the radome at a depth of 0.1 inch into the radome structure that includes the 0.15 inch thick thermal barrier coating. These temperatures correlate to the "MS-3 Depth 0.1" curve. "MS-11 Surface—No TBC" means Missile Station, 11 inches from the tip of the radome that has no thermal barrier coating. "MS-11 TBC—FS Interface" means Missile Station, 11 inches from the tip of the radome, at the interface between the 0.15 inch thick thermal barrier coating and the radome structure.

The model results showed that the use of such thermal barrier coatings on RF radomes reduced maximum radome structural component temperatures by over 300 degree Fahrenheit. The model results also showed that through-thickness and axial temperature gradients were significantly reduced with use of the thermal barrier coatings applied to RF radomes. In addition, the data showed that by limiting thermal barrier coating treatment to the forward sector of the radome, axial thermal gradients in the material can be substantially reduced. The lower temperature gradients significantly reduce internal stresses that could result in catastrophic radome fracture. Conclusions relative to radome transmission, erosion resistance, and impact resistance were based on engineering judgments extrapolated from the material science in the formulated coatings. Dielectric property measurements on a candidate thermal barrier coating material were made at temperatures up to 1500 degrees Fahrenheit and support the conclusion that stable RF transmission can be achieved through the thermal barrier coating over the required radome operating temperature ranges. Candidate thermal barrier coatings applied to large (18"×18") titanium panels were supplied by Ocellus, Inc. of Livermore, Calif. They were tested for 4 hours at 1100 degrees Fahrenheit, 170 decibel acoustic noise engine exhaust wash environments. The thermal barrier coatings exhibited excellent adhesion during the early phases of testing and were resistant to the erosive exhaust gas flow and acoustic vibration over the 4 hour test period. This combined acoustic and thermal test duration exceeds anticipated high supersonic and hypersonic flight times for RF radomes which are likely to be less than 15 minutes in duration.

Figure 11:
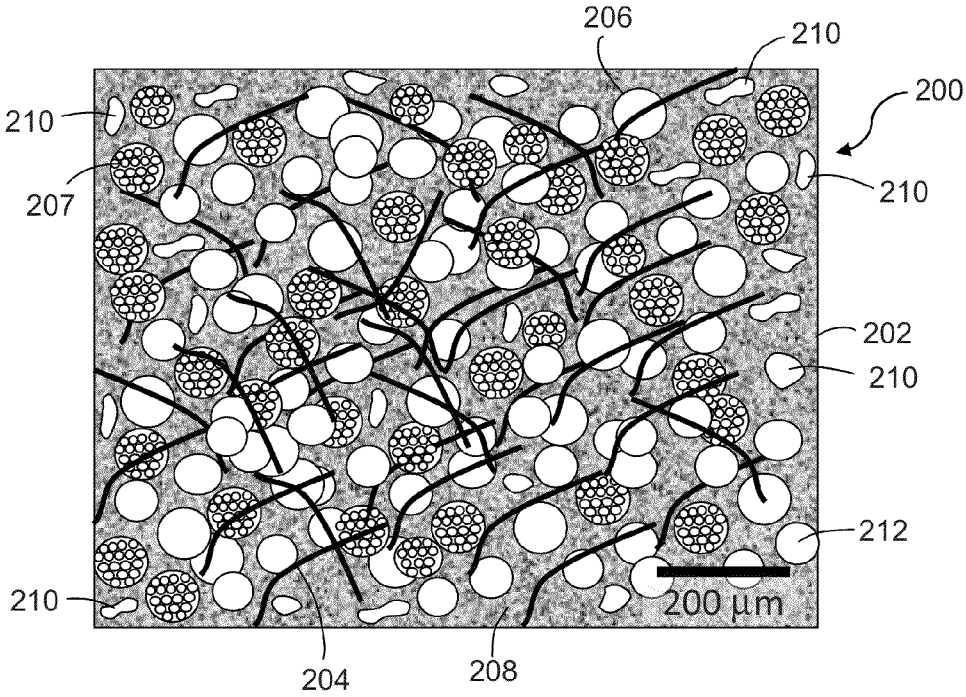
FIG. 11 is an illustration of an enlarged microstructure of an embodiment of a thermal barrier coating of the disclosure.

FIG. 11 is an illustration of an enlarged microstructure 200 of an embodiment of a thermal barrier coating 202 of the disclosure. The microstructure 200 of the thermal barrier coating 202 comprises distributed random fibrils 204, 60% by volume of micro-balloons 206 and aerogels 207, and a glazing binder resin 208 with high open porosity 210 in open cell foam (e.g., irregular shaped interconnected porosity in binder). In this embodiment, the micro-balloons and aerogels may occupy up to about 60% of the overall volume with significant point contacts between the particles. A gaseous volume 212 inside the micro-balloons 206 and aerogels is closed porosity. Porosity 210 in the glazing binder resin 208 may or may not be interconnected. If the porosity is interconnected, it forms an "open cell foam". If the porosity is not interconnected, as shown in FIG. 11, it forms a "closed cell foam". The volume fraction of porosity 210 in the glazing binder resin 208 may range from 0% to 25%. A binder can coat the micro-balloons or other fillers and adhere the system together at the point contacts. In some of the preferred, non-ablating, ceramic formulations, fibrils 204 may be used to enhance strength, particularly in high total porosity formulations. Fibrils 204 can be of uniform length or of varying length. Fibrils 204 improve toughness and shear/erosion resistance.

Figure 12:
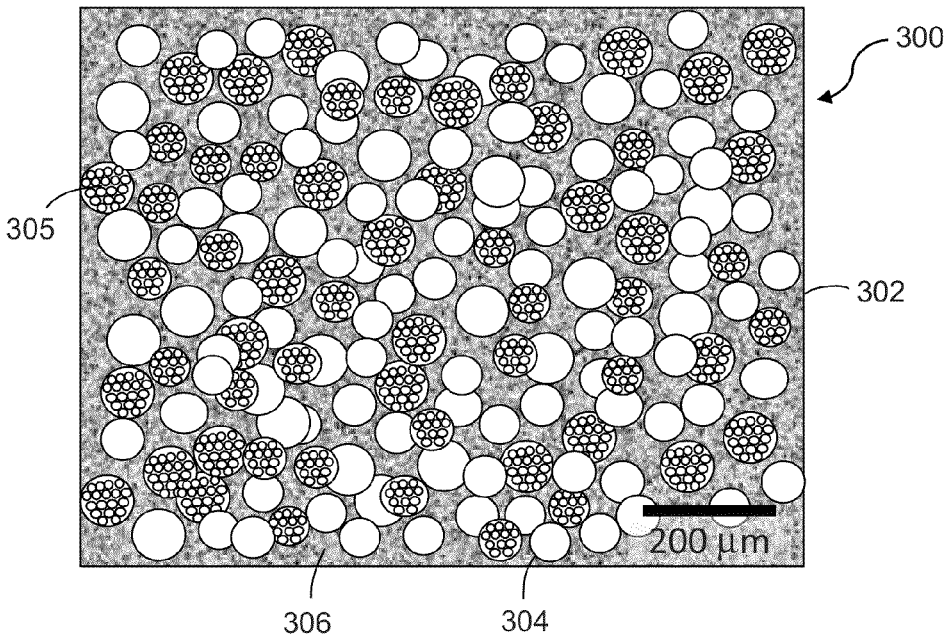
FIG. 12 is an illustration of an enlarged microstructure of another embodiment of a thermal barrier coating of the disclosure; and, FIG. 13 is an illustration of a flow diagram of an embodiment of a method of making an embodiment of a thermal barrier coated RF radome of the disclosure.

FIG. 12 is an illustration of an enlarged microstructure 300 of another embodiment of a thermal barrier coating 302 of the disclosure. The microstructure 300 of the thermal barrier coating 302 comprises no fibrils, 60% by volume micro-balloons 304 and aerogels 305, and no porosity in a resin binder 306. FIG. 12 shows the microstructure 300 with no porosity in the resin binder 306, although another embodiment may include isolated porosity to form a closed cell foam.

Figure 13:
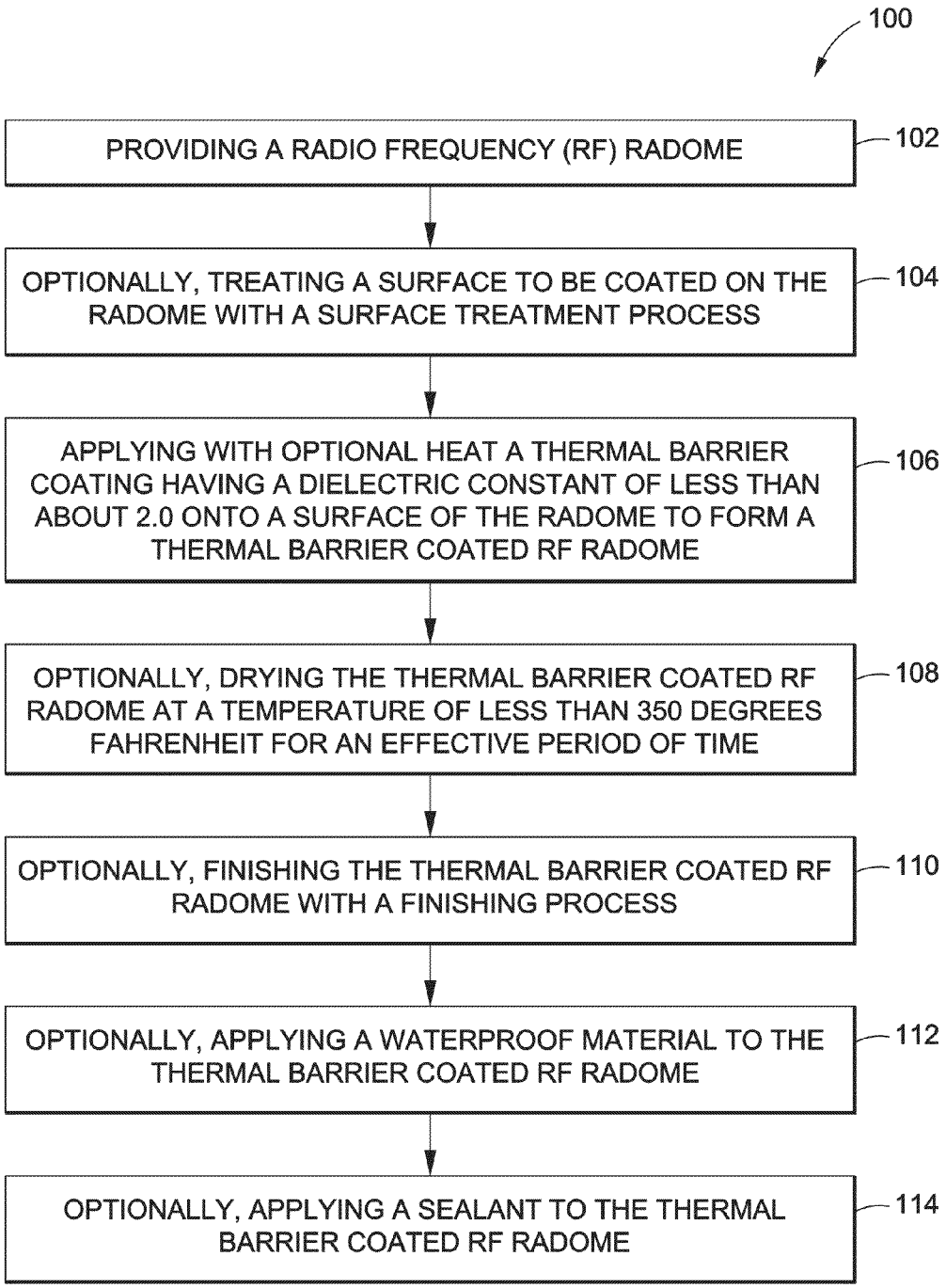

FIG. 13 is an illustration of a flow diagram of an embodiment of a method 100 of coating an RF radome of the disclosure. The method 100 comprises providing a radio frequency (RF) radome (see FIGS. 3, 5). The RF radome may comprise polymeric matrix composites (PMCs) including glass/epoxy, quartz/bismaleimide, quartz/cyanate ester, quartz/polyimide, and alumina-boria-silica fibers (such as 3M NEXTEL 312)/polybenzimidazole; ceramic matrix composites (CMCs) including quartz/polysiloxane, quartz/polysilazane, oxide/oxides, and alumina-boria-silica fibers/aluminum silicate; and monolithic ceramics including fully dense silicon nitride ($Si_3N_4$), reaction bonded silicon nitride (RBSN), in situ reinforced barium aluminum silicate (IRBAS), PYROCERAM 9606 polycrystalline glass ceramic (from Corning Incorporated of Corning, N.Y. —PYROCERAM is a registered trademark of Corning Incorporated of Corning N.Y.), fused silica, and gel cast silicon aluminum oxy nitride (SiAlON), or another suitable material. The method 100 may further comprise step 104 of treating a surface to be coated on the radome with a surface treatment process. The surface treatment process may comprise chemical etching, grit blasting, sanding, liquid honing, corona treatment, peel ply treatment, a combination thereof, or another suitable surface treatment process. The method 100 further comprises step 106 of applying a thermal barrier coating (see FIGS. 4, 6) preferably having a dielectric constant less than about 2.0 onto a surface of the radome to form a thermal barrier coated RF radome. More preferably, the thermal barrier coating has a dielectric constant less than about 1.5. The thermal barrier coating preferably reduces the structure temperature of the RF radome by greater than 300 degrees Fahrenheit to enhance thermo-mechanical properties, performance, all weather flight capability, and environment surviveability of the RF radome. The thermal barrier coating preferably has a porosity of up to 80% by volume of the thermal barrier coating. The thermal barrier coating may be applied to the surface of the radome at an effective temperature of less than 350 degrees Fahrenheit. In one embodiment, the thermal barrier coating has a tapered thickness in a range of from about 0.002 inch to about 0.20 inch. A first thickness of the thermal barrier coating on a forward sector of the radome is greater than a second thickness of the thermal barrier coating on an aft sector of the radome. In another embodiment, the thermal barrier coating applied to the surface of the radome has a uniform thickness in a range of from about 0.050 inch to about 0.20 inch. The thermal barrier coating may comprise a charring material, a non-charring material, or another suitable material. Charring materials may preferably comprise nano polytetrafluoroethylene (PTFE) with or without glass or quartz micro-balloons; micro porous polytetrafluoroethylene (PTFE) with or without glass or quartz micro-balloons; silicone; entrained air; glass micro-balloons; milled glass fiber; phenolic foam; phenolic micro-balloons; syntactic polysiloxane foams, or another suitable charring material. Non-charring materials may preferably comprise silica aerogel; alumina aerogel; silica micro-balloons; alumina micro-balloons; quartz milled fibers; alumina-boria-silica milled fibers; silicate based binders with entrained porosity; aluminum phosphate; sodium silicate; potassium silicate; barium aluminum silicate; aluminum silicate, or another suitable non-charring material. The thermal barrier coating may be applied to the radome surface via an application process such as robotic spray coating, thermal spray coating, direct molding onto the radome, secondary bonding of a pre-molded thermal barrier coating with a high temperature adhesive, or another suitable process.

The method 100 may further comprise step 108 of drying the thermal barrier coated RF radome at a temperature of less than 350 degrees Fahrenheit for an effective period of time, such as, for example from 1 hour to 4 hours, depending on the thermal barrier coating used. The method 100 may further comprise step 110 of finishing the thermal barrier coated RF radome with a finishing process. The finishing process may comprise milling, sanding, cleaning with filtered compressed air, solvent cleaning, a combination thereof, or another suitable finishing process. The method 100 may further comprise step 112 of applying a waterproof material to the thermal coated RF radome. The waterproof material may comprise hexamethyldisilazane (HMDS), dimethyldiethoxysilane (DMDES), and other silane based chemistries, a waterproofing sealant, or another suitable waterproof material. The method 100 may further comprise step 114 of applying a sealant 54 (see FIGS. 4, 6) to the thermal barrier coated RF radome. The sealant is preferably a high temperature sealant resistant to a temperature of greater than 700 degrees Fahrenheit. The sealant may comprise silicon ceramic matrix materials such as Dampney THURMALOX 240 or 243 silica coatings (from Dampney Company, Inc. of Everett, Mass. —THURMALOX is a registered trademark of Dampney Company, Inc. of Everett, Mass.); silicon carbide; Kerathin 1700 aluminum silicate (from Rath USA of Newark, Del.); Mid-Mountain Materials THERMOSEAL P110 aluminum silicate thermal coating (from Mid-Mountain Materials, Inc. of Mercer Island, Wash. —THERMOSEAL is a registered trademark of Mid-Mountain Materials, Inc. of Mercer Island, Wash.), toughened low temperature cure (TLTC) sealants such as silicone, fluoroelastomer, or polyurethane sealants; aluminum phosphate; aromatic hydrocarbon resin sealant; or another suitable sealant. The thermal barrier coated radio frequency (RF) radome preferably has enhanced performance and surviveability in extreme environmental conditions.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting or exhaustive. Although specific terms are employed herein, they are used in a generic and descriptive sense only and not for purposes of limitation.

What is claimed is:

1. A method for coating a radio frequency (RF) radome comprising:

forming a thermal barrier coating material comprising aerogels and micro-balloons, and a binder; and, applying the thermal barrier coating material onto a surface of the RF radome to form a thermal barrier coating having a dielectric constant less than about 2.0 on the RF radome, wherein the thermal barrier coating reduces a temperature of the RF radome structure by greater than 300 degrees Fahrenheit compared to an uncoated RF radome.

2. The method of claim 1 further comprising prior to applying the thermal barrier coating material to the surface of the RF radome, treating a surface to be coated on the RF radome with a surface treatment process comprising chemical etching, grit blasting, sanding, liquid honing, corona treatment, peel ply treatment, or a combination thereof.

3. The method of claim 1 further comprising after applying the thermal barrier coating material, drying the thermal barrier coated RF radome at a temperature of less than 350 degrees Fahrenheit.

4. The method of claim 1 further comprising after applying the thermal barrier coating material, finishing the thermal barrier coated RF radome with a finishing process comprising milling, sanding, cleaning with filtered compressed air, solvent cleaning, or a combination thereof.

5. The method of claim 1 further comprising applying a waterproof material to the thermal barrier coated RF radome, wherein the waterproof material is selected from the group consisting of hexamethyldisilazane (HMDS), dimethyldiethoxysilane (DMDES), silane based chemistries, and a waterproofing sealant.

6. The method of claim 1 further comprising after applying the thermal barrier coating material, applying a sealant to the thermal barrier coated RF radome, wherein the sealant is resistant to a temperature of greater than 700 degrees Fahrenheit and is selected from the group consisting of silicon ceramic matrix materials, silica, silicon carbide, aluminum silicate, aluminum phosphate, toughened low temperature cure (TLTC) silicone, TLTC fluoroelastomer, TLTC polyurethane, and aromatic hydrocarbon resin.

7. The method of claim 1 further comprising prior to forming the thermal barrier coating material, forming the RF radome made of a material selected from the group consisting of glass/epoxy polymeric matrix composites (PMCs), quartz/bismaleimide PMCs, quartz/cyanate ester PMCs, quartz/polyimide PMCs, and alumina-boria-silica fibers/polybenzimidazole PMCs; quartz/polysiloxane ceramic matrix composites (CMCs), quartz/polysilazane CMCs, oxide/oxides CMCs, and alumina-boria-silica fibers/aluminum silicate CMCs; and fully dense silicon nitride monolithic ceramics, reaction bonded silicon nitride ($Si_3N_4$) monolithic ceramics, in situ reinforced barium aluminum silicate (IRBAS) monolithic ceramics, polycrystalline glass ceramic monolithic ceramics, fused silica monolithic ceramics, and gel cast silicon aluminum oxy nitride (SiAlON) monolithic ceramics.

8. The method of claim 1 wherein the forming of the thermal barrier coating material comprises using aerogels and micro-balloons selected from the group consisting of nano polytetrafluoroethylene (PTFE) with glass or quartz micro-balloons; micro porous polytetrafluoroethylene (PTFE) with glass or quartz micro-balloons; glass micro-balloons; quartz micro-balloons; phenolic micro-balloons; silica aerogels; alumina aerogels; silica micro-balloons; and alumina micro-balloons.

9. The method of claim 1 wherein the applying of the thermal barrier coating material further comprises applying the thermal barrier coating material via an application process comprising robotic spray coating, thermal spray coating, direct molding onto the RF radome, or secondary bonding of a pre-molded thermal barrier coating with a high temperature adhesive.

10. The method of claim 1 wherein the applying of the thermal barrier coating material further comprises applying the thermal barrier coating material to the surface of the RF radome at a tapered thickness in a range of from about 0.002 inch to about 0.20 inch, such that a first thickness of the thermal barrier coating material on a forward sector of the RF radome is greater than a second thickness of the thermal barrier coating material on an aft sector of the RF radome.

11. The method of claim 1 wherein the applying of the thermal barrier coating material further comprises applying the thermal barrier coating material to the surface of the RF radome at a uniform thickness in a range of from about 0.050 inch to about 0.20 inch.

12. The method of claim 1 wherein the forming of the thermal barrier coating material further comprises forming the thermal barrier coating material by adding milled fibers selected from the group consisting of glass milled fibers, quartz milled fibers, and alumina-boria-silica milled fibers.

13. The method of claim 1 wherein the applying of the thermal barrier coating material onto the surface of the RF radome further comprises forming the thermal barrier coating material having a dielectric constant less than about 1.5.

14. The method of claim 1 wherein the forming of the thermal barrier coating material further comprises forming the thermal barrier coating material with a porosity of up to 80% by volume of the thermal barrier coating.

15. The method of claim 1 wherein the applying of the thermal barrier coating material onto the surface of the RF radome further comprises applying the thermal barrier coating material to an exterior surface of the RF radome or to an interior surface of the RF radome.

16. The method of claim 1 wherein the forming of the thermal barrier coating material comprises using the binder selected from the group consisting of silicate based binders with entrained porosity, resin binders, aluminum phosphate, sodium silicate, potassium silicate, barium silicate, and aluminum silicate.

17. The method of claim 1 wherein the forming of the thermal barrier coating material comprises forming the thermal barrier coating material comprising a plurality of distributed random fibrils, 60% by volume of the aerogels and micro-balloons, and a glazing binder resin.

18. A method for coating a high speed radio frequency (RF) radome, the method comprising:

forming a thermal barrier coating material comprising aerogels and micro-balloons, and a binder;

treating a surface to be coated on the high speed RF radome with a surface treatment process comprising chemical etching, grit blasting, sanding, liquid honing, corona treatment, peel ply treatment, or a combination thereof;

applying the thermal barrier coating material onto the treated surface of the RF radome to form a thermal barrier coating having a dielectric constant less than about 2.0 on the RF radome, wherein the thermal barrier coating reduces a temperature of the RF radome by greater than 300 degrees Fahrenheit compared to an uncoated RF radome;

drying the thermal barrier coated RF radome at a temperature of less than 350 degrees Fahrenheit;

finishing the thermal barrier coated RF radome with a finishing process comprising milling, sanding, cleaning with filtered compressed air, solvent cleaning, or a combination thereof;

applying a waterproof material to the thermal barrier coated RF radome, wherein the waterproof material is selected from the group consisting of hexamethyldisilazane (HMDS), dimethyldiethoxysilane (DMDES), silane based chemistries, and a waterproofing sealant; and, applying a sealant to the thermal barrier coated RF radome, wherein the sealant is resistant to a temperature of greater than 700 degrees Fahrenheit and is selected from the group consisting of silicon ceramic matrix materials, silica, silicon carbide, aluminum silicate, aluminum phosphate, tough low temperature cure (TLTC) silicone, TLTC fluoroelastomer, TLTC polyurethane, and aromatic hydrocarbon resin.

19. The method of claim 18 further comprising prior to forming the thermal barrier coating material, forming the RF radome from a material selected from the group consisting of glass/epoxy polymeric matrix composites (PMCs), quartz/bismaleimide PMCs, quartz/cyanate ester PMCs, quartz/polyimide PMCs, and alumina-boria-silica fibers/polybenzimidazole PMCs; quartz/polysiloxane ceramic matrix composites (CMCs), quartz/polysilazane CMCs, oxide/oxides CMCs, and alumina-boria-silica fibers/aluminum silicate CMCs; and fully dense silicon nitride monolithic ceramics, reaction bonded silicon nitride ($Si_3N_4$) monolithic ceramics, in situ reinforced barium aluminum silicate (IRBAS) monolithic ceramics, polycrystalline glass ceramic monolithic ceramics, fused silica monolithic ceramics, and gel cast silicon aluminum oxy nitride (SiAlON) monolithic ceramics.

20. The method of claim 18 wherein the forming of the thermal barrier coating material comprises using aerogels and micro-balloons selected from the group consisting of nano polytetrafluoroethylene (PTFE) with glass or quartz micro-balloons; micro porous polytetrafluoroethylene (PTFE) with glass or quartz micro-balloons; glass micro-balloons; quartz micro-balloons; phenolic micro-balloons; silica aerogels; alumina aerogels; silica micro-balloons; and alumina micro-balloons.

21. The method of claim 18 wherein the forming of the thermal barrier coating material comprises using the binder selected from the group consisting of silicate based binders with entrained porosity, resin binders, aluminum phosphate, sodium silicate, potassium silicate, barium silicate, and aluminum silicate.

22. The method of claim 18 wherein the forming of the thermal barrier coating material further comprises adding milled fibers selected from the group consisting of glass milled fibers, quartz milled fibers, and alumina-boria-silica milled fibers.

23. The method of claim 18 wherein the forming of the thermal barrier coating material comprises forming the thermal barrier coating material comprising a plurality of distributed random fibrils, 60% by volume of the aerogels and micro-balloons, and a glazing binder resin.

* * * * *